US011933592B2

(12) United States Patent
Viggiano

(10) Patent No.: US 11,933,592 B2
(45) Date of Patent: Mar. 19, 2024

(54) AMMUNITION CASING HAVING A CANNELURE WITH STEP

(71) Applicant: Shell Shock Technologies LLC, Westport, CT (US)

(72) Inventor: Anthony Viggiano, Groton, CT (US)

(73) Assignee: SHELL SHOCK TECHNOLOGIES INC, Westport, CT (US)

( * ) Notice: Subject to any disclaimer, the term of this patent is extended or adjusted under 35 U.S.C. 154(b) by 0 days.

(21) Appl. No.: 17/683,335

(22) Filed: Feb. 28, 2022

(65) Prior Publication Data

US 2022/0260347 A1 Aug. 18, 2022

Related U.S. Application Data

(60) Continuation-in-part of application No. 16/916,825, filed on Jun. 30, 2020, now Pat. No. 11,262,171, which is a division of application No. 16/383,633, filed on Apr. 14, 2019, now Pat. No. 10,697,743, which is a continuation-in-part of application No. 15/221,530, filed on Jul. 27, 2016, now Pat. No. 10,260,847.

(60) Provisional application No. 63/191,993, filed on May 22, 2021.

(51) Int. Cl.
*F42B 5/285* (2006.01)
*F42C 19/08* (2006.01)

(52) U.S. Cl.
CPC ..... *F42B 5/285* (2013.01); *F42C 19/0807* (2013.01)

(58) Field of Classification Search
CPC ..... F42B 5/26–36
See application file for complete search history.

(56) References Cited

U.S. PATENT DOCUMENTS

| | | | | |
|---|---|---|---|---|
| 10,697,743 | B2 * | 6/2020 | Viggiano | F42B 5/285 |
| 11,262,171 | B1 * | 3/2022 | Viggiano | F42C 19/0807 |
| 2019/0242679 | A1 * | 8/2019 | Viggiano | F42B 5/285 |

FOREIGN PATENT DOCUMENTS

| | | | | |
|---|---|---|---|---|
| EP | 3540365 | A1 * | 9/2019 | F42B 5/285 |

* cited by examiner

*Primary Examiner* — Bret Hayes
(74) *Attorney, Agent, or Firm* — CANTOR COLBURN LLP; Steven M. McHugh

(57) ABSTRACT

A casing for an ammunition cartridge comprises a sleeve portion and a base portion. The casing may be two-piece, where the base portion is secured to the sleeve portion by means of a nipple having a flared end. The base portion comprises a cannelure that extends lengthwise from a flange. The cannelure, which is preferably curved, is deeper than a conventional cannelure and thus the casing weight is reduced. The cannelure has a step that is adjacent the flange, for limiting inward travel of the lip of a hook of the bolt of a firearm. Alternatively, a casing may be a one-piece casing, wherein the base and sleeve are integral.

9 Claims, 4 Drawing Sheets

AMMUNITION CASING HAVING A CANNELURE WITH STEP

This application is a continuation in part of patent application Ser. No. 16/916,825, filed on 2019, now U.S. Pat. No. 10,697,743, which is a continuation in part of application Ser. No. 15/221,530 filed Jul. 27, 2016, now Pat. No. 10,260,847. This application claims benefit of provisional patent application 63/191,993 filed May 22, 2021.

TECHNICAL FIELD

The present invention relates to ammunition for firearms, in particular to the configuration and use of cartridges and casings that comprise such ammunition.

BACKGROUND

U.S. Pat. No. 9,939,236 of Drobockyi et al. and U.S. Pat. No. 10,260,847 of Viggiano et al. describe among other things a two-piece casing comprised of sleeve and a base. The sleeve, preferably made of magnetically attractive stainless steel, has a concavity for containing gunpowder and, at a first end, a mouth for holding a projectile. At the opposing second end, the sleeve has an integral nipple which is positioned within a central passageway of the base. The tip of the nipple is flared onto a shoulder within the passageway. When applied to such as 9 mm ammunition, the base may be formed of aluminum alloy and the cannelure may be in accord with well-known cannelures. Casings made in accord with the teachings of the '236 and '847 patents provide advantages over conventional forged brass casings, including lower weight, increased gunpowder volume, and in being magnetically attractive.

When, as in 7.62×51 mm NATO ammunition, casings are subject to particularly high gunpowder deflagration pressures compared to those associated with 9 mm ammunition, it has been found advantageous to fabricate the base from a high strength steel alloy. Compared to using an aluminum alloy, that has the undesirable effect of increasing weight of a casing. U.S. Pat. No. 10,697,743 of Viggiano et al. describes a casing for ammunition characterized by having a deep, curved-section cannelure, which compares with the combination of cylindrical and frusto-conical portions of a cannelure in familiar ammunition. FIG. 3 of this present application shows in partial cross section a casing having a cannelure of the '743 patent. The special cannelure lessens the weight penalty that attends the use of a steel or another heavier-than-aluminum material, without compromising the performance of the casing.

During extensive developmental testing of cartridges comprised of two-piece casing characterized by the above-described deep cannelure, there was occasional jamming in the firearm breech of a spent casing when certain firearms were repeat-fired at high speed. An object of the present invention is to avoid such kind of problem.

SUMMARY

An object of the invention is to provide a casing and a cartridge for a firearm with a cannelure which both reduces weight of the article (compared to common ammunition having familiar cannelure configurations) while providing mimimal propensity for jamming in automatic repeating firearms that have a high rate of firing.

In embodiments of the present invention, an ammunition cartridge has a casing that comprises a sleeve and a base.

The sleeve and base may be an integral or they may be separate parts that are secured to each other as a two-piece casing. The sleeve is that portion of the casing which during use contains gunpowder and which has a mouth within which a projectile is held. The sleeve where it is contiguous with the base is typically cylindrical. The base proximal end comprises a flange shaped for being gripped by the hook of a firearm bolt, as in a conventional casing, to enable extraction from a firearm chamber of an empty casing. The casing has a cannelure that extends from the distal-facing surface of the flange to proximity of the sleeve. The canneulure is deep, compared to cannelures of conventional known ammuntion, which provides a benefit of reduced weight.

A circumferential running step, which also may be called a ledge, is within the cannelure adjacent the flange. The step timits the extent to which the lip at the tip of a hook of a bolt can enter the cannelure. A step may have a cylindrical surface or, for example, a surface that lightly curves inward toward the casing lengthise axis with distance from the flange. A step may be spaced apart from the flange by a groove. Preferably, a cannelure comprises a portion which runs from the step inward toward the centerline of the casing, preferably curvingl; and a contiguous portion that runs from the foregoing portion conically or curviningly outwardly to a cylindrical surface of the base having a diameter which is equal to the diameter of the sleeve. A step avoids any tendency of the tip of a fireram bolt hood to make wedging contact with a curved portion of the cannelure. In other embodiments, the cannelure may run cylindrically, and then curvingly from the step.

During used, when the bolt of a typical firearm engages with the proximal end of the casing of a cartridge, the lip at the end of a pivotable hook part of the bolt enters the cannelure but its inward motion is limited by the step with the casing cannelure. A cartridge of the present invention comprises an invention casing that has a projectile positioned in the mouth of the sleeve, a quantity of gunpowder within the sleeve, and a primer within the passageway proximal end. The objects of the invention are achieved; lighter weight deep-cannelure cartridges are fired in a repeating firearm without jamming.

The foregoing and other objects, features and advantages of the present invention will become more apparent from the following description of preferred embodiments and accompanying drawings.

BRIEF DESCRIPTION OF THE DRAWINGS

FIG. 4C shows how the lip end of a spring actuated hook moves radially inward to grasp the flange of the casing.

DESCRIPTION

Reference herein to a cartridge (also sometimes called a "round") is a reference generally to a piece of ammunition that is suitable for firing in a firearm. A cartridge comprises a casing, gunpowder in the casing, a projectile, and a primer. Well-known casings have a cannelure, a circumscribing radially-depressed region, or groove, running distally from the casing flange which is at the proximal end of the casing/cartridge. The proximal end comprises a central recess. The opposing distal end of the casing comprises the casing mouth. A cartridge ready for firing in a firearm comprises gunpowder inside the concavity of the casing, a projectile held within the mouth end, and a primer set in the central recess of the proximal end.

While most invention embodiments herein are described in connection with the two-piece casings, other embodiments of are in the form of a one-piece casing. A two-piece casing that embodies the present invention comprises a first portion called a sleeve that is shaped to hold gunpowder and to receive a projectile that closes the mouth, and a mated second portion called a base that is shaped to hold a primer. The sleeve and base portions may be separately formed and attached to each other as described in U.S. Pat. No. 9,625,241 Neugebauer, U.S. Pat. No. 9,939,236 Drobockyi et al, U.S. Pat. No. 10,260,847 Viggiano et al., and U.S. Pat. No. 10,697,743 Viggiano et al. The disclosures of said patents are hereby incorporated by reference, each in its entirety. In other embodiments of the present invention, the sleeve and the base portions may be integral with each other (as they are in conventional forged brass casings).

In a familiar prior art and in a present invention casing, a circumscribing groove or cannelure is located between the flange and the sleeve portion of the casing. The cannelure enables a hook on the bolt of a firearm to extract a casing from a firearm chamber after a round is fired. Understanding the process of placing a round in the chamber of a firearm and its removal after firing will be first described here, to inform about the functioning and benefit of the present invention.

Figure 1:
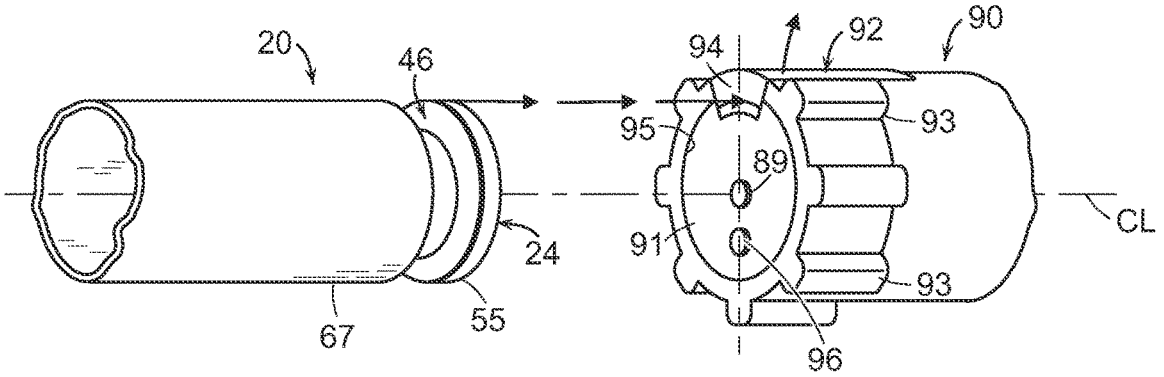
FIG. 1 PRIOR ART
FIG. 1 is an exploded perspective view of portions of a prior art cartridge that is contacted by a bolt of an automatic-fire weapon.
Figure 2:
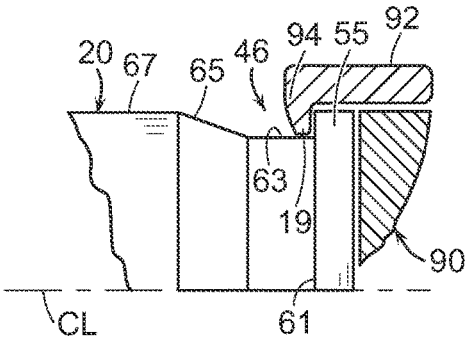
FIG. 2 PRIOR ART
FIG. 2, which relates to FIG. 1, is a partial side view of a prior art casing of a cartridge, showing how the flange of the casing is engaged by a hook portion of a bolt.
Figure 3:
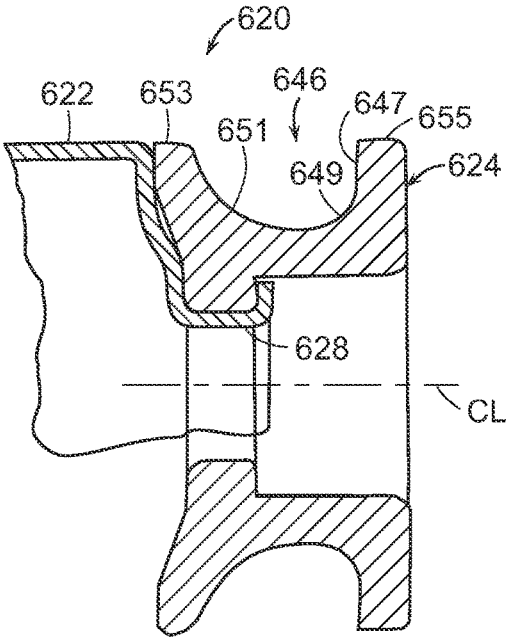
FIG. 3 is a partial cross section of a two piece casing having a deep curved cannelure.
Figure 4A:
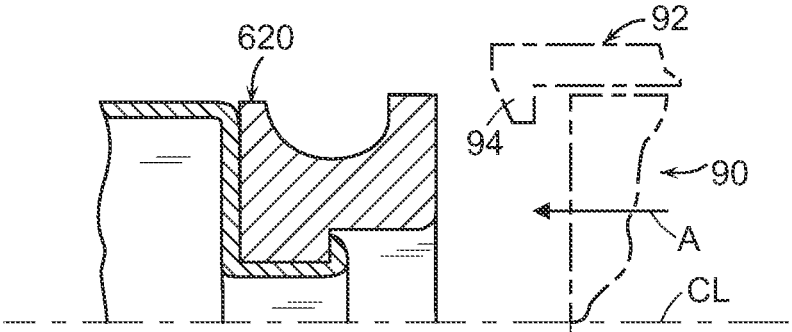
FIG. 4A, FIG. 4B and FIG. 4C are related sequential views that illustrate how the engagement of the base of a casing, shown in cross section, with the bolt of a firearm, partially shown in phantom, first causes the hook of the bolt to move radially outwardly from its home position. Then, with further motion of the bolt.
Figure 4B:
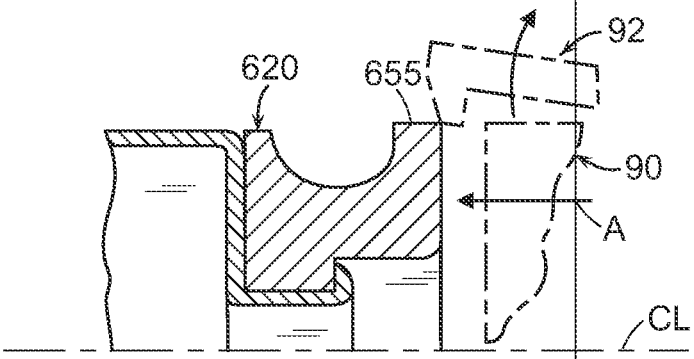
Figure 4C:
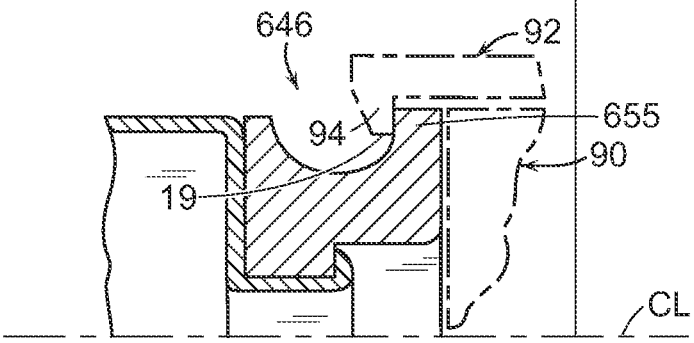

FIG. 1 is a semi-schematic exploded view of the end of a firearm bolt 90 in combination with a prior art casing 20. FIG. 2 shows the same casing in engagement with the bolt. FIG. 3 shows an improved cannelure of the '825 application. FIGS. 4A, 4B, and 4C are sequential, showing how the bolt approaches the base of a cartridge preparatory to pushing the cartridge "home", i.e., into the chamber (not shown) of the firearm.

With reference to FIG. 1 and FIG. 2, a casing 20 comprises a sleeve portion 67 and an integral base portion 24. Casing 20 comprises a cannelure 46 of typical well-known form, such as in a familiar prior art 7.62×51 mm NATO cartridge. Cannelure 46 comprises a circumscribing groove or channel on the exterior of the casing. The cannelure has a lengthwise dimension (which also may be called the width) that runs from the flange to a point in vicinity of the sleeve, at which location the base has a nominally constant diameter that is equal to the diameter of the adjacent portion of the sleeve. Cannelure 46 is characterized as follows: First, at its proximal end by a surface 61—that is the distal-facing surface of flange 55. Second, in its middle portion by contiguous cylindrical surface 63. Third, at its distal end by a contiguous conical surface 65 which surface runs both outwardly to meet cylindrical surface 67 of the base that is adjacent the sleeve portion of the casing. Exemplarily, the thickness of a flange 55 may be about 1.23 mm and the diameter of the surface 63 may be about 10.3 to 10.4 mm.

Figure 7:
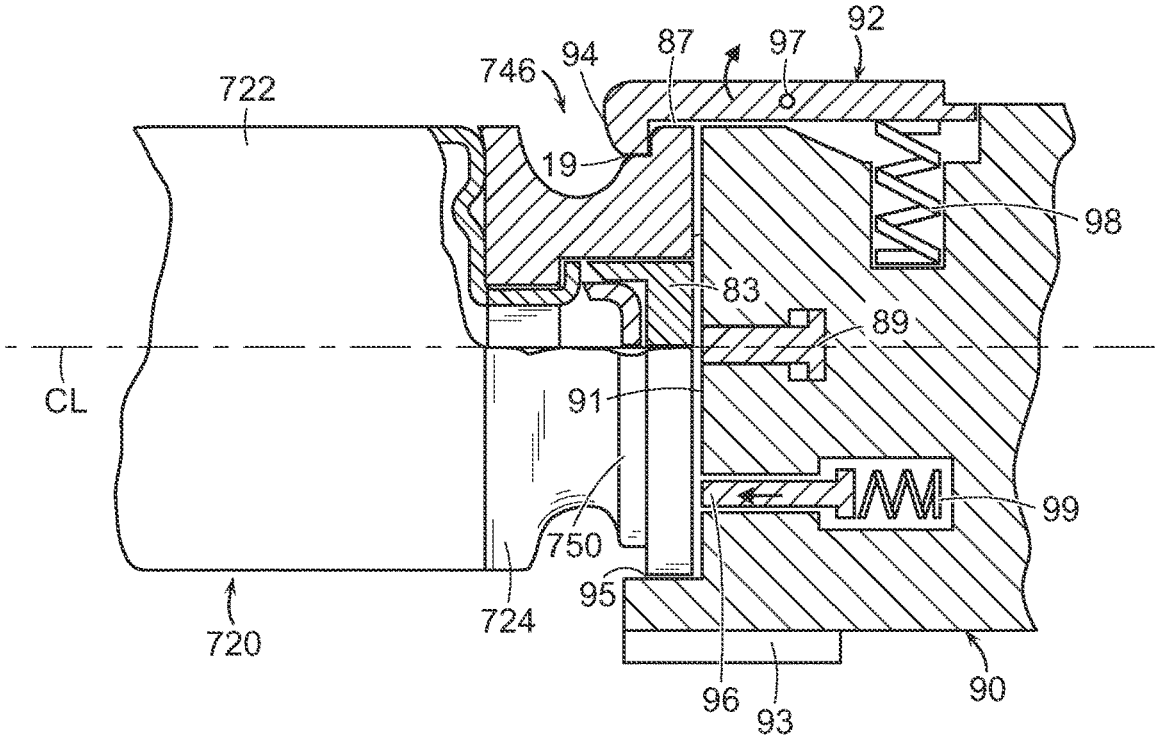
FIG. 7 is a side view of a portion of a casing like that of FIG. 6, showing the casing engaged with the bolt of a firearm. Internal details of the bolt are shown in the partial cross section.

With particular reference to FIG. 1 and FIG. 7, a typical bolt 90 comprises hook 92. The hook comprises a shank that pivots about pin 97. At the outermost end of the hook is lip 94 that extends radially inward toward the centerline CL of the bolt (which will also be the centerline of any casing engaged by the bolt). The lip of the hook drops into the cannelure when the face 91 of the bolt mates with the proximal end of a cartridge to push the cartridge into the firearm chamber. When the bolt retracts from the chamber after the cartridge/round is fired, the hook pulls on the flange of the casing to extract it from the chamber. As shown in FIG. 2, when used with a casing having a conventional cannelure, the inward-facing surface of tip 19 of lip 94 may rest on the cylindrical surface 63 of the cannelure 46. And typically there will be a small clearance space between the shank of the hook and the rim of flange 55.

When a firearm is configured for repeat or automatic firing, cartridges are magazine-fed or belt-fed into the firearm breech, within which breech the bolt translates. In a representative firing cycle, the bolt pushes a cartridge into the empty chamber of the firearm (not shown). After firing, the bolt retracts, to pull the spent casing from the chamber and back into the breech area, from which it is instantly ejected by a spring loaded pin 96 in the bolt. FIG. 7 shows a cross section of part of bolt 90, in combination with an exemplary present-invention casing 720, which casing is discussed below. FIG. 1 and FIG. 7 shows various details of the bolt in somewhat simplified or semi-schematic fashion.

Referring particularly to FIG. 1 and FIG. 7, when a fresh cartridge is presented at the breech, the bolt moves forward along lengthwise axis CL to insert the cartridge into the chamber of the firearm. During that process, casing flange 55 is received within recess 95 of the bolt face which has a planar base surface 91. Pushing the cartridge "home" within the chamber results in casing flange 55 hitting the firearm structure (not shown) that circumscribes the chamber opening. The bolt then rotates through a small circumferential angle about its axis CL, thereby locking the bolt by means comprising bolt spline segments 93, thereby enabling the bolt to resist the reaction force from deflagration pressure within the casing. After firing of the projectile, the bolt rotates in a reverse direction to the first rotation, allowing simultaneous rearward movement of the bolt and extraction of the casing from the chamber.

In complement to the foregoing: When the bolt first touches the casing portion of a cartridge, the angled terminal end of lip 94 of hook 92 causes the free end of the hook to deflect radially outwardly. See FIG. 4A and FIG. 4B. Pivoting of the hook about pin 97 compresses bolt spring 98. See FIG. 7. With continued diminution of the distance between the bolt and casing, the base of the casing is received within recess 95 on the face of the bolt; and, spring 98 causes the hook to pivot about pin 97, so lip 94 moves radially inwardly and drops into cannelure 46. See FIG. 4C. The bolt then continues forward until the cartridge stops at its home position with the firearm chamber. Gas pressure within the firearm barrel due to gunpowder deflagration both propells the projectile out of the barrel and, via channeling within the firearm, causes the bolt to rotationally unlock and move rearwardly, away from the chamber. As the bolt moves away from the chamber, hook 92 pulls flange 55 and thus the whole now-empty casing out of the chamber. Within the recess 95 on the bolt face is extraction pin 96, which is biased by spring 99. (The pin is shown as it has been pushed inwardly by contact of casing with the bolt in FIG. 7.) When the bolt retracts and pulls the mouth of the casing from the chamber, the spring-urged ejection pin pushes on the casing and makes the casing fly from recess 95 and from engagement with hook 92; the spent casing flies into space, upwardly and laterally from the breech of the weapon. That allows a new cartridge to be introduced into the breech, so the load-fire-eject cycle may repeat. If the spent casing does not fly properly from the breech, a jam may likely result.

FIG. 3 is a partial cross section of a two-piece casing 620 having a curved cannelure, in accord with casings disclosed in the '743 patent. Casing 620 comprises sleeve 622 which is secured to base 624 by sleeve nipple 628, the end of which is flared against a shoulder within the bore of a passageway that runs lengthwise through the base. The cannelure 646 is defined by a planar surface 647 which runs radially inwardly from the distal side surface of flange 655; a contiguous lengthwise-extending curving surface comprising a first portion 649 that runs first inwardly and lengthwise and a second portion 651 that runs curvingly outward to meet cylindrical surface 653 of the base which has substantially the same diameter as the exterior of sleeve 622. All the foregoing surfaces may be called surfaces of revolution.

The minimum diameter of the contiguous curving portions 649, 651 is substantially less than the diameter of cylindrical surface 63 of a conventional prior art casing 20, such as shown in FIG. 2. Thus, a casing 620 made of steel or other strong metal alloy has advantageously low weight compared to a same-caliber same-metal casing with a conventional shape cannelure—yet the casing is strong enough to resist the high deflagration pressures associated with such as NATO 7.62×51 mm cartridges. Alternative configurations of two-piece casings having a base attached to a sleeve may be employed, including a casing where a third component rivet is used to hold the sleeve and base to each other, an example of which is shown as connection component 24 in FIG. 3 of the above-cited patent 9,625,241 of Neugebauer. Casings may alternatively be formed as one-piece casings having substantially the same cannelure as described for two-piece casings.

Figure 5:
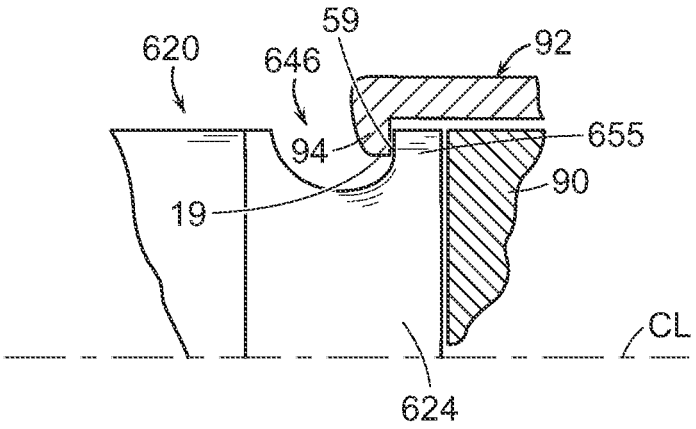
FIG. 5 is a side view of the base of a casing having a curved cannelure as it mated with a bolt, shown partially in cross section and is grasped by the hook of a bolt.

Numerous tests were carried out by firing cartridges comprising casings 620 in an automatic repeating firearm. An occasional jam of the bolt was observed. The low rate of jam-occurrence meant that ascertaining the cause was difficult. FIG. 5 shows base 624 of casing 620 as it is engaged with hook 92 of bolt 90, to illustrate the never-verified suspicion that jamming might be caused by a degree of wedging of the tip 19 of lip 94 against the cannelure at point 59, where the cannelure starts curvingly running lengthwise, possibly due to miniscule manufacturing variances in shape or finish, despite what was thought to be a precision manufacturing process.

Jamming was eliminated by forming within the curved cannelure a feature which is called herein a step, but which might also be called a ledge. A step within a cannelure is a circumscribing surface portion of the cannelure that is configured to limit, without wedging, the radially inward travel of the lip of a hook toward the centerline of a casing when, if the step were absent, the lip of the hook could extend more deeply into an invention cannelure that has a minimum diametrical dimension that is less than which characterizes a conventional cannelure.

Figure 6:
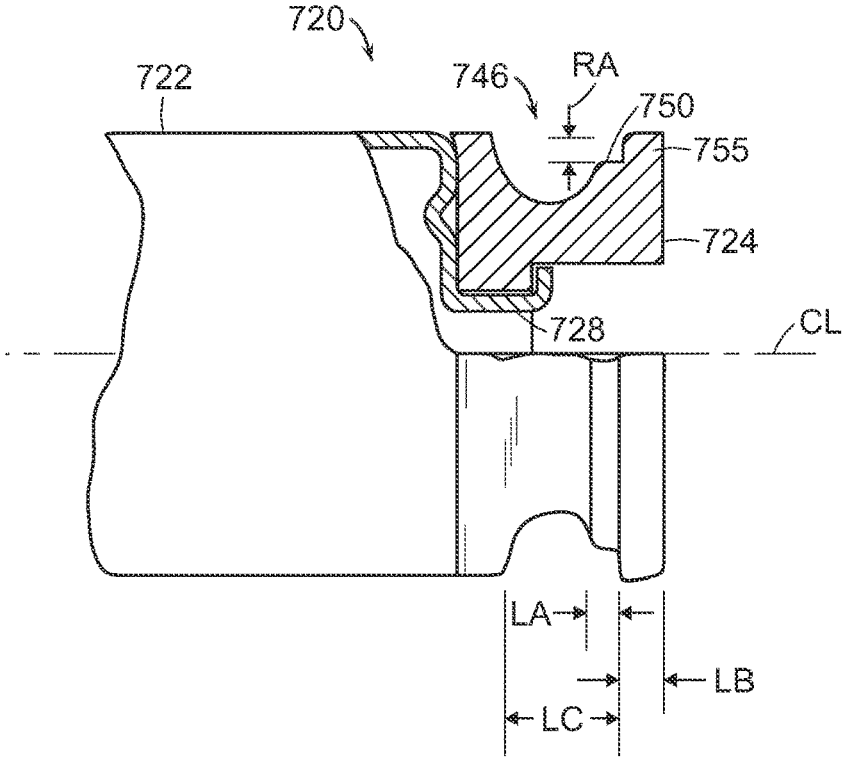
FIG. 6 is a partial cutaway side view of a two piece casing having a curved cannelure with a circumscribing step that limits radially inward motion of the tip of the hook.

FIG. 6 and FIG. 7 show an embodiment of the present invention, namely two-piece casing 720 comprised of sleeve 722, which is attached to base 724 by a flared nipple 728. Base 724 has a curved cannelure 746, within which is step 750. FIG. 7 shows casing 720 as it is held in contact with bolt 90, with the tip 19 of the lip 94 in contact with step 750 and with the lip 94 of the hook griping the distal face of flange 755.

In use of the invention, when base 724 of a cartridge 720 is engaged with bolt 90, the radially-inward facing surface of the tip 19 of the lip 94 of hook 92 rests on step 750, thereby limiting the extent of spring-induced radial inward movement of the lip toward length axis CL.

An exemplary step for a NATO 7.62×51 mm cartridge has a diameter is about 10.3 mm and an axial length of about 0.7 mm. (The step diameter of an exemplary casing 720 may be about the same as the diameter of the cylindrical surface 63 of a conventional 7.62×51 mm round. See FIG. 2.) For reference, in an exemplary casing, the CL axis direction length of the tip 19 of a lip 94 of a hook 92, where it contacts a casing step or cannelure (as applies) in a representative firearm using 7.62×51 mm cartridges is about 1.3 mm. For reference, the exemplary casing has a flange diameter that is about 11.8 mm and the thickness at the outer rim location is about 1.23 mm; both those dimensions being nominally the same as characterizes a conventional cartridge flange.

With reference again to FIG. 7, in embodiments of a NATO 7.62×51 mm casing, the step prevents the hook underside surface from contacting the circumferential surface of the flange rim. For example, there will be a gap 87 of about 0.03 to 0.05 mm between the hook and the flange circumferential surface.

With reference again to FIG. 6: In an embodiment of the invention, step 750 of casing 720 is a cylindrical surface having a radius which is dimension RA less than the about 5.9 mm radius of the flange 755 of a 7.62×51 mm cartridge. An exemplary dimension RA is about 1 mm. In other embodiments of the same size cartridge, dimension RA can be between 1 mm and 1.6 mm. As mentioned, dimension RA is preferably chosen so that, for a particular bolt and hook configuration, the centerline-facing surface of the hook body is kept from contacting the exterior surface of the flange. In an embodiment of the invention as it is configures for use with a 7.62×51 mm cartridge, the flange 755 axial length (thickness) LB is about 1.3 mm; and step axial length (also called the step width) LA may be between about 0.6 mm and 1.27 mm. A step with somewhat smaller or somewhat larger axial length may be used. Since the purpose of the deep cannelure is to reduce the weight of the base, minimizing the step axial length is favored. However, if it is desirable that the full radial-facing surface of the bolt lip contact a cannelure circumscribing surface, then it would be desirable to have the step length approximate the length of the lip in that is parallel to centerline axis CL.

The length LC of the exemplary cannelure 746 is about 3 mm, which as pointed out includes the axial length of the step. Thus, an exemplary step of 0.6 mm to 1.27 mm length will be about 20 to about 42 percent of the 3 mm length of the exemplary cannelure.

Figure 9:
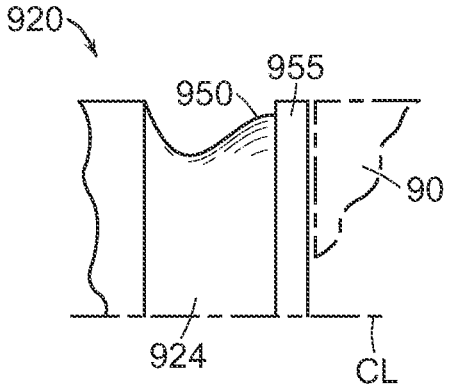
FIG. 9 is a side view of a portion of a casing having a cannelure with at step that has a radial-facing surface that curves in toward the lengthwise axis.
Figure 8:
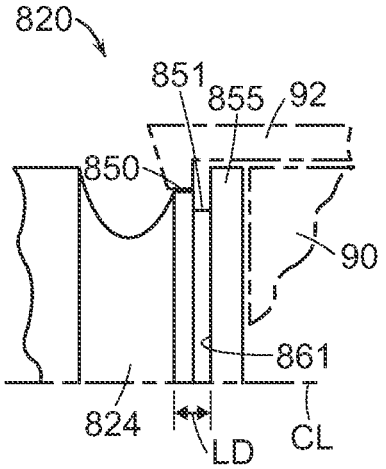
FIG. 8 is a side view of a portion of a casing having a cannelure with a step that is spaced apart from the interior (distal) face of the flange.

FIG. 8 shows another embodiment of the invention, namely base 824 in which step 850 is spaced apart by groove 851 from the distal-facing, annular surface 861 that extends inwardly from the distal side annular surface of flange 855. Dimension LD in FIG. 8, the distance from the flange distal face to the distal edge of the step, may be equal to a dimension LA in FIG. 6. The configuration of base 824 thus can provide a step having functional equivalent to step 750 of casing 720 (shown in FIG. 6), with lowered weight of casing. In embodiments of the invention, a step may be other than a smooth cylindrical surface, so long as it is functionally equivalent with respect to limiting inward motion of the hook. For example, a step may comprise a plurality of closely spaced circumscribing ribs. For another example, FIG. 9 shows casing 920 that comprises a base 924 with step 950 that has an outward facing surface that curves inwardly in the lengthwise direction; the curvature is less than that which might cause the aforementioned hypothesized wedging of a hook.

While in embodiments of the invention it is preferred that a cannelure comprise a continuously curving surface, as described in the '743 patent, approximations of a curve—for instance a series of contiguous conical surfaces—are within the scope of the invention as equivalents.

Figure 10:
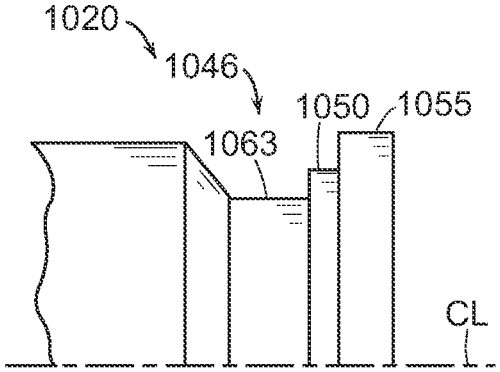
FIG. 10 is a side view of a portion of a single piece casing having a cannelure step.

FIG. 10 shows an embodiment of one-piece casing 1020, which has a non-curved cannelure that includes a step. Except for the step, casing 1020 has a cannelure 1065 that is generally like that which characterizes the prior art cartridge brass casing 20 in FIG. 2. Casing 1020 comprises flange 1055; cannelure 1046 comprises an annular portion that extends inwardly from the annular distal-face of flange 1055, a contiguous cylindrical section 1063, and a contiguous outwardly-running conical section. Casing 1020 comprises cylindrical step 1050 which has a diameter consistent with that described above in connection with casing 720. The step diameter and length dimensions and step variations (e.g., an adjacent groove and/or a lengthwise-direction curved surface) that were previously described for casing 720 may be used in an exemplary casing 1020.

When in an embodiment of one-piece casing 1020 the smallest diameter of the cannelure cylindrical section 1063 is substantially smaller than the diameter of the cannelure of a comparable prior art casing, the material of a casing 1020 needs to be both sufficiently formable to make the sleeve portion and sufficiently strong to resist the deflagration pressures applied to the base. The feasibility of such casing 1020 depends on how large the cannelure is, what the deflagration pressures are, and what the material choices are. A two piece casing having a cannelure shaped like that shown in casing 1020 is within the scope of the present invention. An advantage of the two piece casing over a one-piece casing is that the metal of the sleeve can be chosen primarily for its formability and the metal of the base can be chosen primarily for its strength.

Another way of characterizing an embodiment of casing of the present invention is as follows: The casing comprises a central lengthwise axis, a base portion which has a flange that is at the proximal end of the casing, and a sleeve portion having a mouth shaped to receive a projectile, wherein the mouth is at the distal end of the casing. The base portion comprises a first annular side of the flange which faces proximally and surrounds a recess shaped to receive a primer. The cannelure extends in the distal direction from the opposing second annular side of the flange to vicinity of where the base portion mates with, or is integral with, the sleeve portion. The cannelure is comprised of the following surface portions circumscribing the central length axis:

(a) a first annular portion facing distally, the portion being co-planar with the distal facing surface of the flange;

(b) a second cannelure portion (also called the step portion) which is either contiguous with the first annular portion or spaced apart therefrom by a groove, the step portion extending lengthwise and having a diameter which is less than the outside diameter of the flange;

(c) a third cannelure portion, contiguous with the step portion and (i) running inwardly toward the casing centerline along plane or a curve from the step portion and then (ii) extending cylindrically or curvingly lengthwise from the step portion in the direction of the distal end of the casing; wherein, the third cannelure portion has a sub-portion with a diameter that is less than the diameter of the second cannelure portion; and, (d) a fourth cannelure surface portion, contiguous with the third cannelure surface portion, running curvingly or conically away from the centerline axis to the base, to a cylindrical portion of the base that has nominally the same diameter as the adjacent sleeve.

The just-described casing may be a one-piece casing, or a two-piece casing comprised of a sleeve attached to a base.

An embodiment of the present invention comprises a method of firing a projectile from a cartridge in a firearm which comprises: (a) forming a cartridge comprising the casing described above, wherein a primer is positioned within the recess at the proximal end of the base portion, wherein a quantity of gunpowder is contained within the sleeve portion, and wherein a projectile is secured within the mouth of the sleeve portion; (b) pushing the cartridge into the chamber of a firearm by contacting the proximal end of the casing of the cartridge with the face of a bolt of a firearm, wherein the lip at the end of a movable hook portion of the bolt gasps said casing flange and wherein said lip contacts the step of the base of the casing; (c) by means of a firing pin of the bolt, causing the gunpowder within the sleeve portion to deflagrate and to thereby expel the projectile from the casing portion mouth; and, (d) then, pulling the casing from the chamber of the firearm by means of said bolt and hook.

The invention, with explicit and implicit variations and advantages, has been described and illustrated with respect to several embodiments. Those embodiments should be considered illustrative and not restrictive. Any use of words such as "preferred" and variations suggest a feature or combination which is desirable but which is not necessarily mandatory. Thus embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. A casing for ammunition used in a firearm, the casing having a lengthwise centerline, a proximal end having a recess shaped for receiving a primer, and an opposing distal end comprising a mouth for receiving and holding a projectile, the casing comprising:

a sleeve portion, for holding a quantity of gunpowder, the sleeve portion having a distal end characterized by said mouth, and an opposing proximal end from which runs lengthwise a cylindrical exterior surface having an associated diameter;

a base, having a distal end characterized by a cylindrical portion that is securely mated with or integral with said proximal end of sleeve portion, a proximal end characterized by a flange having a first side annular flange surface that forms at least a portion of said casing proximal end and an opposing second side annular flange surface that faces toward the distal end, the base further characterized by a cannelure situated between the flange and the distal end of the base, the cannelure characterized by a first cannelure surface portion that faces distally and comprises at least a portion of said second side annular flange surface;

a second cannelure surface portion that is either contiguous with said first cannelure surface portion or spaced apart therefrom by a groove, the second cannelure surface portion extending lengthwise as a step having a diameter which is less than the diameter of the flange;

a third cannelure surface portion, running inwardly from the second cannelure surface portion toward the casing centerline along a plane or a curve, and then extending lengthwise cylindrically or curvingly; and, a fourth cannelure surface portion, running outwardly from the third cannelure surface portion and away from the casing lengthwise centerline, the surface portion having either a conical or curved shape.

2. The casing of claim 1 wherein the third cannelure surface portion runs inwardly toward the casing centerline along a curve and then extends curvingly lengthwise.

3. The casing of claim 1 wherein the third cannelure surface portion runs inwardly toward the casing centerline along a curve and then extends curvingly lengthwise, and wherein the fourth cannelure surface portion runs curvingly outwardly with respect to said lengthwise centerline.

4. The casing of claim 1 wherein the cannelure third surface portion runs cylindrically lengthwise; and wherein the fourth cannelure surface portion runs conically outwardly with respect to the centerline of the base.

5. The casing of claim 4 wherein the sleeve portion and base portion are integral with each other.

6. The casing of claim 1 wherein the base and the sleeve are separate components that are connected to each other.

7. The casing of claim 6 wherein the base has a central lengthwise passageway, and wherein the sleeve comprises a nipple positioned within the lengthwise passageway, wherein the nipple tip is flared against a shoulder within the passageway to hold the base and the sleeve to each other.

8. The casing of claim 1 in combination with a projectile positioned in said mouth, a quantity of gunpowder within the sleeve portion, and a primer cap within the bore of the base portion, thereby forming a cartridge; in further combination with a bolt of a firearm, the bolt having a hook; wherein the proximal end of the flange is in contact with the bolt and the hook has a lip positioned to pull on the flange first surface when the bolt moves in a direction away from the flange; and wherein the lip of the hook rests said step of the first surface.

9. A method of firing a projectile from a cartridge in a firearm which comprises:

(a) forming a cartridge comprising the casing of claim 1 and placing a primer in the recess of the proximal end of the base portion, placing a quantity of gunpowder within the sleeve portion, and placing a projectile within the mouth of the sleeve portion;

(b) pushing the cartridge into the chamber of a firearm by contacting the proximal end of the casing of the cartridge with the face of a bolt of a firearm, wherein the lip at the end of a movable hook portion of the bolt gasps said casing flange and wherein said lip contacts the step of the base of the casing;

(c) through a firing pin within the bolt, causing the gunpowder within the sleeve portion to deflagrate and to thereby expel the projectile from the casing portion mouth; and, (d) pulling the casing from the chamber of the firearm by means of said bolt and hook.

* * * * *